US009121176B2

(12) United States Patent
Rites

(10) Patent No.: US 9,121,176 B2
(45) Date of Patent: Sep. 1, 2015

(54) THERMAL CLIP FOR BUILDING CONSTRUCTION

(71) Applicant: Marcal Rites, Toronto (CA)

(72) Inventor: Marcal Rites, Toronto (CA)

( * ) Notice: Subject to any disclaimer, the term of this patent is extended or adjusted under 35 U.S.C. 154(b) by 0 days.

(21) Appl. No.: 14/045,287

(22) Filed: Oct. 3, 2013

(65) Prior Publication Data

US 2015/0096261 A1 Apr. 9, 2015

(51) Int. Cl.

| | |
|---|---|
| ***E04C 3/00*** | (2006.01) |
| ***E04C 5/16*** | (2006.01) |
| ***E04C 3/02*** | (2006.01) |

(52) U.S. Cl.

CPC .. *E04C 5/162* (2013.01); *E04C 3/02* (2013.01)

(58) Field of Classification Search

CPC ..... E04C 3/02; E04C 5/162
USPC ..... 52/831, 407.4, 506.05, 506.03, 105, 52/235, 474, 509, 512, 24, 26
See application file for complete search history.

(56) References Cited

U.S. PATENT DOCUMENTS

| | | | | |
|---|---|---|---|---|
| 2,088,781 | A * | 8/1937 | Folsom | 52/634 |
| 2,256,961 | A * | 9/1941 | Pearson et al. | 52/407.4 |
| 3,363,381 | A * | 1/1968 | Forrest | 52/464 |
| 4,011,700 | A * | 3/1977 | Sado | 52/235 |
| 4,107,887 | A * | 8/1978 | Wendt | 52/105 |
| 5,044,130 | A * | 9/1991 | Chiddister | 52/24 |
| 5,709,058 | A * | 1/1998 | Shaw | 52/404.1 |
| 6,402,415 | B1 * | 6/2002 | Eberle, III | 403/231 |
| 7,587,877 | B2 * | 9/2009 | Strickland et al. | 52/837 |
| 7,661,234 | B2 * | 2/2010 | Voegele, Jr. | 52/466 |
| 7,673,433 | B2 * | 3/2010 | Rutman et al. | 52/843 |
| 7,795,329 | B2 * | 9/2010 | Nosker et al. | 523/204 |

* cited by examiner

*Primary Examiner* — Basil Katcheves
(74) *Attorney, Agent, or Firm* — Elias Borges

(57) ABSTRACT

There is disclosed a mounting clip for mounting an exterior metal cladding from an exterior sheathing in a building to form a set off between the metal cladding and the sheathing. The mounting clip is made of a plastic material having a low thermal conductivity and is made in the general form of an I-beam with parallel first and second flat portions held together by a web portion. The second flat portion is longer than the first web portion so as to accommodate mounting apertures in order to make the mounting clip easier to install.

4 Claims, 3 Drawing Sheets

THERMAL CLIP FOR BUILDING CONSTRUCTION

FIELD OF THE INVENTION

The invention relates generally to spacing clips for mounting metal roof sheeting to the exterior sheathing of a building construction.

BACKGROUND OF THE INVENTION

Metal roof sheeting is often used in the construction of buildings, particularly commercial buildings. The metal sheeting is thermally conductive and is therefore often mounted such that the metal sheeting is set off from the exterior sheathing to accommodate a layer of insulation. A plurality of bolts or screws is used to mount the metal sheeting directly to the exterior sheathing with a plurality of spacers used to keep the metal sheeting and exterior sheathing parallel. While this system is simple and secure, it does result in a thermal coupling between the metal sheeting and the exterior sheathing via the bolts and screws used to mount the two together. Furthermore, using a combination of spacers and mounting bolts/screws requires multiple steps and more effort to be employed because of the need to use very long mounting bolts or screws. An improved spacing clip for mounting the metal roof sheeting is therefore desirable.

SUMMARY OF THE INVENTION

In accordance with one aspect of the present invention, there is provided A mounting clip for mounting metal roof sheeting to exterior sheathing of a building. The clip includes an elongated I beam made of a polymer having a low thermal conductivity, the elongated I beam having a first and second flat portions separated by a web portion, the web portion holding the first and second flat portions parallel to each other. The first flat portion has a width extending between opposite first and second sides and a length extending between opposite first and second ends, the second flat portion having a width extending between opposite first and second sides and a length extending between opposite first and second ends. The width of the first flat portion is substantially equal to the width of the second flat portion such that the first and second sides of the first flat portion are parallel to the first and second sides of the second flat portion. The web portion has a width extending between opposite first and second ends, the width of the web portion being substantially equal to the length of the first flat portion such that the first end of the web portion is continuous with and substantially flush with the first end of the first flat surface and the second end of the web is continuous with the second end of the first flat surface. The length of the second flat portion is greater than the length of the first flat portion, the web portion being coupled to the second flat portion midway between the first and second ends of the second flat portion, the length of the second flat portion being greater than the width of the web such that first end of the second flat portion is spaced from the first end of the web and the second end of the second flat portion is spaced from the second end of the web. A first pair of apertures is formed on the second flat portion between the first ends of the web and second flat portion, and a second pair of apertures formed on the second flat portion between the second ends of the web and second flat portion.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 1:
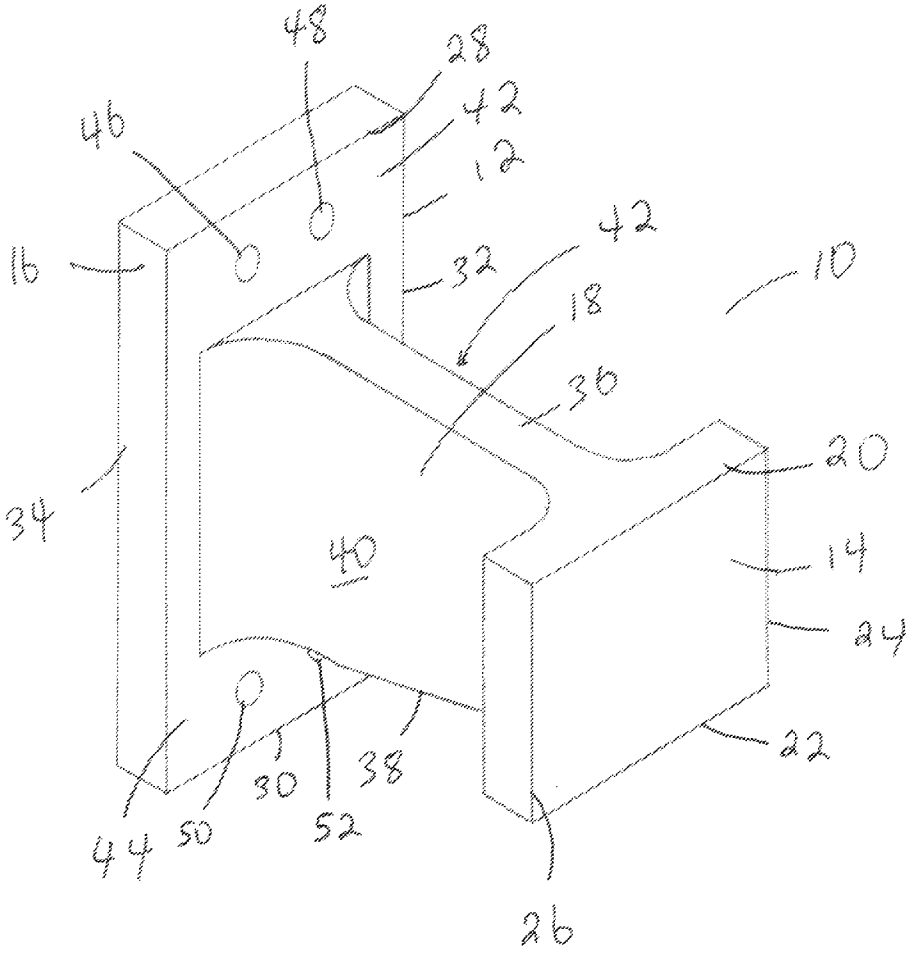
FIG. 1 is a perspective view of a thermal clip made in accordance with one aspect of the present invention.

Referring firstly to FIG. 1, a mounting clip made in accordance with the present invention is shown generally as item 10 and consists of an elongated member 12 generally in the shape of an I beam having a first flat portion 14, a second flat portion 16 and a web 18. Flat portion 14 has first and second ends 20 and 22, and opposite side edges 24 and 26. Flat portion 16 has opposite ends 28 and 30 and opposite side edges 32 and 34. Web portion 18 has opposite ends 36 and 38 and opposite sides 40 and 42.

Flat portion 14 has a length which extends between opposite ends 20 and 22. Likewise, web 18 has a width which extends between ends 36 and 38. The length of flat portion 14 is the same as the width of web 18 where the web meets flat portion 14 such that end 20 is flush with end 36 and end 22 is flush with end 38. Flat portion 16 has a length extending between ends 28 and 30. Web portion 18 is placed in the center of flat portion 16. The length of flat portion 16 is greater than the width of web 18 so that spaces 42 and 44 are formed between the web and ends 28 and 30, respectively. Two pairs of apertures are formed adjacent the ends of flat portion 16, with apertures 46 and 48 formed on either side of web 18 and apertures 50 and 52 formed on either side of web 18.

Figure 2:
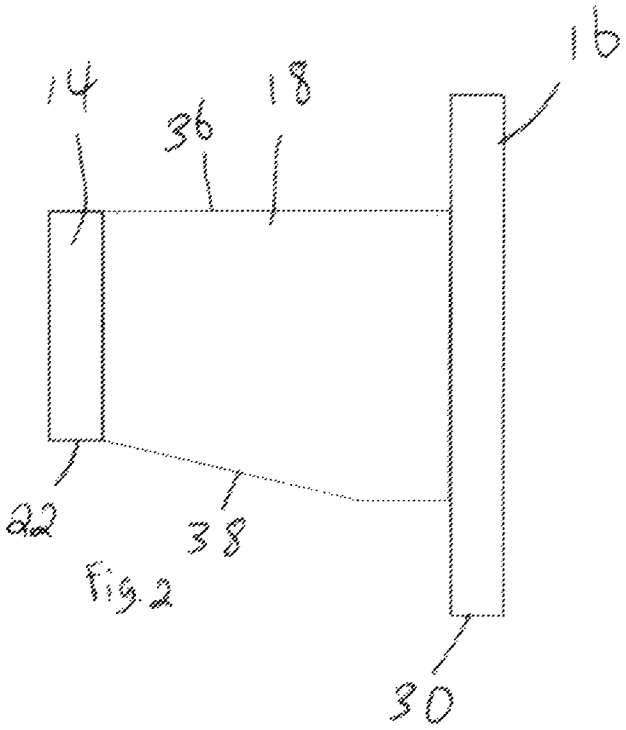
FIG. 2 is a side view of the thermal clip shown in FIG. 1.

Referring now to FIG. 2, end 38 of web portion 18 is tapered such that the width of the web is greater near flat portion 16 as compared to near flat portion 14. As shall be discussed below, this makes the thermal clip easier to install as it permits more space for a hand operated driver (not shown) to be positioned to attached screws through the apertures positioned near end 30.

Figure 3:
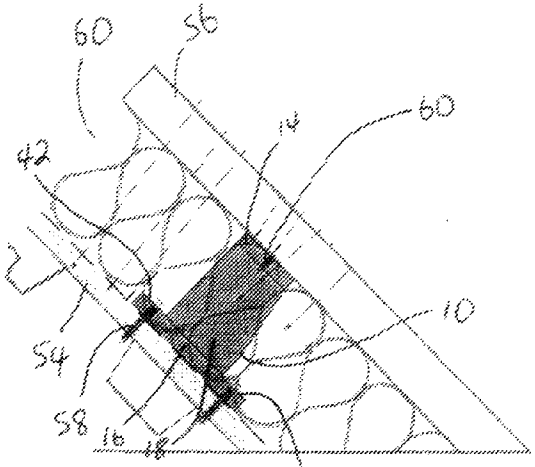
FIG. 3 is a side view of the thermal clip shown in FIG. 1 being used in a building construction.
Figure 4:
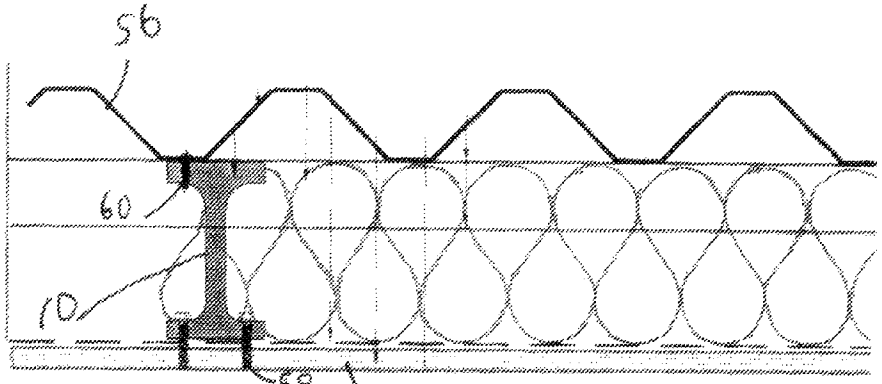
FIG. 4 is a cross sectional view of the thermal clip shown in FIG. 1 being used in a building construction.

Referring now to FIGS. 3 and 4, clip 10 is preferably made of a strong yet thermally resistant material such as fiber reinforced extruded plastic. Several such materials used in manufacturing structural components are well known in the industry. These materials are not only strong, but they have a relatively low thermal conductivity, making them suitable for use in mounting two structural elements together while keeping the structural elements thermally separated. As seen in FIG. 3, clip 10 can be used to mount exterior metal building cladding (such as corrugated metal roofing) sheets 56 to fiber board exterior cladding 54, so as to provide a set off space 60 for insulation. Mounting screws 58 can be used to mount clip 10 directly onto exterior cladding 54. Since the apertures are positioned away from web 18, it is possible to attach screws 58 using hand operated drills (not shown) because the apertures through which the screws are driven are positioned between the web and the ends of flat portion 16. Screws 60 can be driven directly into flat portion 14 of clip 10. It must be appreciated that the worker (not shown) is attaching the metal cladding from outside the structure, and therefore cannot access mounting clip 10 from underneath. Placing the apertures for the mounting screws at extensions 42 and 44 makes it possible for a worker to quickly and easily mount the clip to the exterior cladding 54 without flat surface 14 getting in the way. The tapered portion of the web makes it easier to position the hand drill (not shown) close to the clip so as to drive the screws into the clip. Once clip 10 is mounted to the exterior cladding, the worker can simply place metal cladding 56 over flat surface 14 and drive screws 60 directly through the metal cladding and into the flat surface.

The present invention makes it easy and convenient to mount the metal cladding to a building. Since the clip itself is made of a material having low thermal conductivity, and since none of the mounting screws contact both the metal cladding and the exterior sheathing, the isolative barrier between the metal cladding and the exterior sheathing is not compromised. Also, since it is so easy to mount the clip to the exterior sheathing due to the placement of the mounting apertures on flat surface 16 away from the web and away from flat surface 14, it is possible to quickly mount the clips using less expensive and convenient to use shorter screws.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A mounting clip for mounting metal roof sheeting to exterior sheathing of a building, the mounting clip comprising:

a. An elongated I beam made of a unitarily extruded thermally non-conductive polymer, the elongated I beam having first and second flat portions separated by a web portion, the web portion holding the first and second flat portions parallel to each other, the web portion and the first and second flat portions being integrally formed;

b. The first flat portion having a width extending between opposite first and second sides and a length extending between opposite first and second ends, the second fiat portion having a width extending between opposite first and second sides and a length extending between opposite first and second ends;

c. The width of the first flat portion being substantially equal to the width of the second flat portion such that the first and second sides of the first flat portion are parallel to the first and second sides of the second flat portion;

d. the web portion having a width extending between opposite first and second ends, the width of the web portion being substantially equal to the length of the first flat portion such that the first end of the web portion is continuous with and substantially flush with the first end of the first flat surface and the second end of the web is continuous with the second end of the first flat surface;

e. the length of the second flat portion being greater than the length of the first flat portion, the web portion being coupled to the second flat portion midway between the first and second ends of the second flat portion, the length of the second flat portion being greater than the width of the web such that first end of the second flat portion extends beyond the first end of the web portion to form a first solitary flat extension projecting solitarily away from the first end of the web and the second end of the second flat portion extends beyond the second end of the web portion to form a second solitary flat extension projecting solitarily away from the second end of the web;

f. a first pair of apertures formed on the first solitary flat extension, and g. a second pair of apertures formed on the second solitary flat extension.

2. The mounting clip of claim 1 wherein the web has opposite first and second sides, a first aperture of each of the first and second pairs of apertures formed adjacent the first side of the web and a second aperture of each of the first and second pairs of apertures formed adjacent the second side of the web.

3. The mounting clip of claim 1 wherein the width of the web is greater where the web meets the second flat portion than where the web meets the flat portion.

4. The mounting clip of claim 3 wherein the width of the web tappers from the first flat portion to the second flat portion.

* * * * *